US011203925B2

(12) United States Patent
Tao et al.

(10) Patent No.: US 11,203,925 B2
(45) Date of Patent: Dec. 21, 2021

(54) DRILLING DEVICE AT EXTRACTING OPENING FOR EXTRACTION OF COALBED METHANE

(71) Applicant: China University of Geosciences (Beijing), Beijing (CN)

(72) Inventors: Shu Tao, Beijing (CN); Dazhen Tang, Beijing (CN); Hao Xu, Beijing (CN); Song Li, Beijing (CN); Shida Chen, Beijing (CN)

( * ) Notice: Subject to any disclaimer, the term of this patent is extended or adjusted under 35 U.S.C. 154(b) by 36 days.

(21) Appl. No.: 16/740,361

(22) Filed: Jan. 10, 2020

(65) Prior Publication Data

US 2021/0172312 A1 Jun. 10, 2021

(30) Foreign Application Priority Data

Dec. 6, 2019 (CN) ..... 201911254217.4

(51) Int. Cl.
*E21B 44/04* (2006.01)
*E21B 3/02* (2006.01)

(52) U.S. Cl.
CPC ..... *E21B 44/04* (2013.01); *E21B 3/02* (2013.01)

(58) Field of Classification Search
CPC ..... E21B 44/04; E21B 44/06; E21B 3/02
USPC ..... 175/27, 202
See application file for complete search history.

(56) References Cited

U.S. PATENT DOCUMENTS 3,766,995 A * 10/1973 Young ..... E21B 7/00 175/53
4,049,065 A * 9/1977 Walter ..... E21B 3/02 175/52
5,029,655 A * 7/1991 Ebeling ..... E21B 3/02 175/195
6,092,610 A * 7/2000 Kosmala ..... E21B 4/20 175/61
6,637,522 B2 * 10/2003 Wilson ..... B23Q 11/0046 175/212
7,775,297 B2 * 8/2010 Hopwood ..... E21B 44/00 175/24
2001/0003317 A1 * 6/2001 Klemm ..... F16H 61/44 173/222
2008/0156531 A1 * 7/2008 Boone ..... E21B 44/00 175/27

(Continued)

FOREIGN PATENT DOCUMENTS

CA 2904782 A1 * 9/2014 ..... E21B 44/04

*Primary Examiner* — Frederick L Lagman
(74) *Attorney, Agent, or Firm* — W&KIP

(57) ABSTRACT

In the present disclosure, by providing a rotary torque sensor and an auxiliary drive mechanism, the drilling drive can be well controlled according to the required torque. For example, when encountering rock formations, the auxiliary drive mechanism can be used for simultaneous driving drilling, and when drilling in soft formations, only by disconnecting the transmission can the operation be completed, so as to effectively reduce energy consumption and improve utilization. In the present disclosure, when a rotary torque is greater than a set value, the controller controls the auxiliary drive mechanism to transmit to the main drive column and drive the main drive column, and when the rotary torque is smaller than or equal to the set value, the controller controls the power transmission between the auxiliary drive mechanism and the main drive column to be disconnected.

9 Claims, 4 Drawing Sheets

(56) References Cited

U.S. PATENT DOCUMENTS

| | | | | |
|---|---|---|---|---|
| 2009/0173543 | A1* | 7/2009 | Zupanick | E21B 21/08 175/57 |
| 2015/0345223 | A1* | 12/2015 | Maidla | E21B 7/068 175/26 |
| 2015/0369017 | A1* | 12/2015 | Hu | E21B 3/02 166/244.1 |
| 2016/0010392 | A1* | 1/2016 | Moss | E21B 7/00 175/24 |
| 2016/0326864 | A1* | 11/2016 | Dwars | E21B 7/062 |
| 2017/0002641 | A1* | 1/2017 | Dykstra | E21B 44/08 |
| 2018/0274352 | A1* | 9/2018 | Orban | H02P 6/08 |

* cited by examiner

DRILLING DEVICE AT EXTRACTING OPENING FOR EXTRACTION OF COALBED METHANE

CROSS-REFERENCE TO RELATED APPLICATIONS

This application claims priority to Chinese Patent Application No. 201911254217.4 with a filing date of Dec. 6, 2019. The content of the aforementioned application, including any intervening amendments thereto, are incorporated herein by reference.

TECHNICAL FIELD

The present disclosure relates to an auxiliary construction equipment for extraction of coalbed methane, in particular, to a drilling device at extracting opening for extraction of coalbed methane.

BACKGROUND ART

Currently, before extraction of coalbed methane, drilling is required on the extraction portion of the coalbed methane, so as to extend the extraction equipment into the extracting opening or the extracting hole, and the extracting opening or the extracting hole is required to be located where the drilling is deeper, and the problem of stuck pipes or stuck drill bits may occur during the drilling process due to problems such as rock layers, so the damage may be caused on the drill pipe and even the motor, and the construction period is delayed once the pipe is stuck. At the same time, during drilling, if the drill bit encounters a harder material or part during the drilling process, especially under uneven force conditions, problems such as chipping may be easily to occur, leading a large difficulty in subsequent drilling and affecting the drilling efficiency.

Therefore, the present disclosure provides a drilling device at extracting opening for extraction of coalbed methane, so as to solve the problems in the background.

SUMMARY OF THE INVENTION

An object of the present disclosure is to provide a drilling device at extracting opening for extraction of coalbed methane, so as to solve the problems in the background.

To this end, the present invention provides the following technical solutions.

A drilling device at extracting opening for extraction of coalbed methane includes a drilling machine base, a main drive column, an auxiliary drive mechanism, a drilling liquid injection disc assembly, a main drill pipe, a fine-angle-adjustment mechanism, an secondary drill pipe and a drill bit, wherein a center in the drilling machine base is vertically penetrated with the main drive column, and at least one set of the auxiliary drive mechanism located in the drilling machine base is provided around the main drive column; a position of a lower end of the main drive column extending the drilling machine base is fixed connected to the drilling liquid injection disc assembly, and a lower end of the drilling liquid injection disc assembly is connected to the main drill pipe; a lower end of the main drill pipe is connected to the secondary drill pipe through the fine-angle-adjustment mechanism, and a lower end of the secondary drill pipe is connected to the drill bit;

further including a controller and a rotary torque sensor, the rotary torque sensor capable of detecting a rotary torque of the main drive column and feeding to the controller, the controller capable of controlling the auxiliary drive mechanism according to the rotary torque; and when the rotary torque is greater than a set value, the controller controls the auxiliary drive mechanism to transmit to the main drive column and drives the main drive column, and when the rotary torque is smaller than or equal to the set value, the controller controls a force transmission between the auxiliary drive mechanism and the main drive column to be disconnected;

the fine-angle-adjustment mechanism is capable of controlling the secondary drill bit and/or the drill bit to perform a fine-tuned swinging motion in space, so as to prevent the drill bit from getting stuck or chipping during the drilling process.

Further, preferably, the auxiliary drive mechanism includes an auxiliary motor, a belt transmission mechanism, a main auxiliary drive column, an secondary auxiliary drive column, an auxiliary transmission gear and an auxiliary gear, wherein the auxiliary motor is fixed in the drilling machine base, and an output terminal of the auxiliary motor is connected to the main auxiliary drive column through the belt transmission mechanism; the main auxiliary drive column is coaxially connected to the secondary auxiliary drive column, and the secondary auxiliary drive column is connected with the auxiliary transmission gear; the main drive column is provided with the auxiliary gear, and the auxiliary transmission gear and the auxiliary gear are in detachable/transmittable connection.

Further, preferably, the auxiliary drive mechanism further includes a detachment control driver, and the auxiliary transmission gear is slidably disposed on the secondary auxiliary drive column up and down by the detachment control driver, so as to control the detachment and transmission of the auxiliary transmission gear and the auxiliary gear.

Further, preferably, an anti-over-torque connecting member is adopted between the main auxiliary drive column and the secondary auxiliary drive column, and the anti-over-torque connecting member is configured to automatically rotate relatively when a rotary torque between the main auxiliary drive column and the secondary auxiliary drive column is greater than a certain value, so as to prevent the rotary torque of transmission between the main auxiliary drive column and the secondary auxiliary drive column from being excessive.

Further, preferably, a top of the drilling machine base is provided with a machine cover, a pulley is disposed above the machine cover, and the pulley is connected to an upper end of the main drive column.

Further, preferably, the drilling liquid injection disc assembly includes a disc body, a sealing cover, a sealed liquid injection sleeve, wherein an upper end of the disc body is fixed with the sealing cover, and a lower end of the main drive column extends into the disc body to be fixedly connected to a lower end of the main drill pipe; an outer periphery of the main drill pipe is rotatably connected to the sealed liquid injection sleeve, and the sealed liquid injection sleeve is fixed in the disc body; a radial annular liquid injection tank is disposed on the sealed liquid injection sleeve, and a center of the main drill pipe is provided with a liquid drilling hole; the liquid drilling hole is communicated with the annular liquid injection tank by a radial communication hole.

Further, preferably, one side of the disc body is provided with a liquid injection joint, the liquid injection joint is communicated to the annular liquid injection tank on the sealed liquid injection sleeve, and a sealed and rotatable arrangement is disposed between the sealed liquid injection sleeve and an outer peripheral wall of the main drill pipe.

Further, preferably, the outer peripheral wall of the main drill pipe is opened with at least two sets of concave annular sealed grooves, and positions of the sealed liquid injection sleeve corresponding to the concave annular sealed grooves are provided with sealed annular shoulders extending into the concave annular sealed grooves.

Further, preferably, the fine-angle-adjustment mechanism includes a connecting base, a hydraulic driver, a hydraulic drive column, and a protective disc, wherein an upper end of the connecting base is connected to the main drill pipe, and a lower end of the connecting base is provided with at least one hydraulic drive column driven by the hydraulic driver; a lower end of the hydraulic drive column is hingedly connected to an upper end of the secondary drill pipe by a ball hinge, and a center of the lower end of the connecting base is connected to a center of the secondary drill pipe by a hinged column; the hydraulic drive column is driven up and down, and the protective disc is sleeved around a lower part of the connecting base.

Further, preferably, the detachment control driver includes a detachment hydraulic drive base, a sealed ring, and a drive column, wherein a drive piston is slidably disposed in the detachment hydraulic drive base, and two drive columns are symmetrically connected to the drive piston; the drive columns extend from the detachment hydraulic drive base and are sealed by the sealed ring, and upper ends of the drive column are symmetrically connected to the auxiliary transmission gear.

Compared with the prior art, the present invention has the following beneficial effects:

(1) In the present disclosure, by providing a rotary torque sensor and an auxiliary drive mechanism, the drilling drive can be well controlled according to the required torque. For example, when encountering rock formations, the auxiliary drive mechanism can be used for simultaneous driving drilling, and when drilling in soft formations, only by disconnecting the transmission can the operation be completed, so as to effectively reduce energy consumption and improve utilization. In the present disclosure, when a rotary torque is greater than a set value, the controller controls the auxiliary drive mechanism to transmit to the main drive column and drive the main drive column, and when the rotary torque is smaller than or equal to the set value, the controller controls the power transmission between the auxiliary drive mechanism and the main drive column to be disconnected. In this way, the main drive column can be assisted to prevent problems such as breaking rods;

(2) In the present disclosure, the fine-angle-adjustment mechanism is capable of controlling the secondary drill bit and/or the drill bit to perform a fine-tuned swinging motion in space, so as to prevent the drill bit from getting stuck or chipping during the drilling process, thereby effectively improving the drilling efficiency while preventing drill bit from being damaged.

DETAILED DESCRIPTION OF THE EMBODIMENTS

Figure 1:
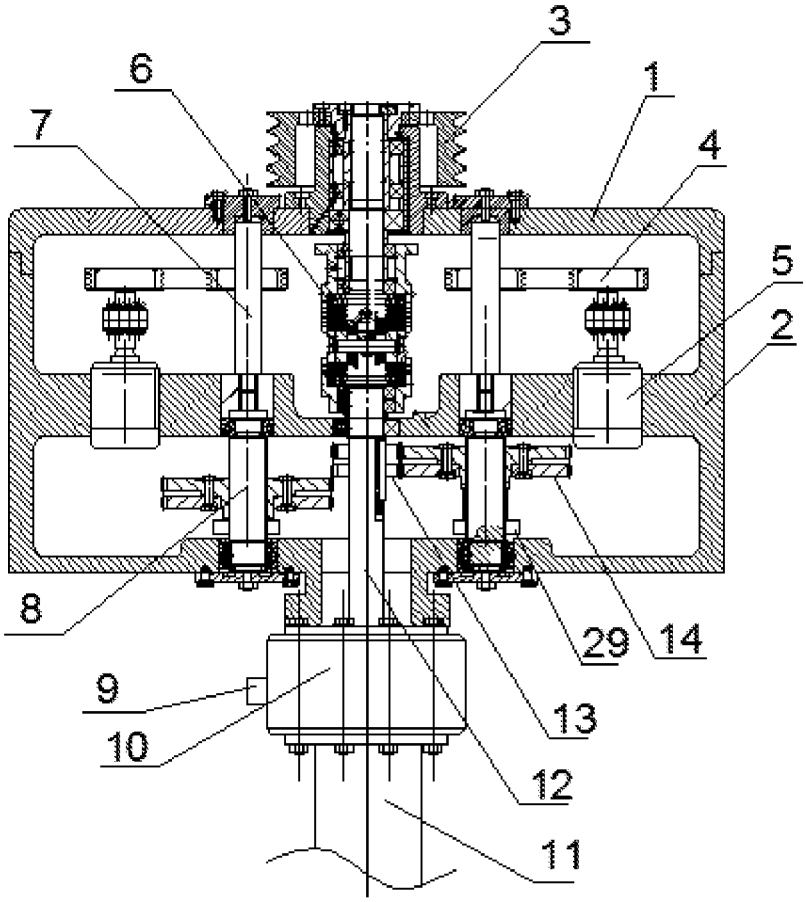
FIG. 1 is a diagram showing an internal structure of a drilling machine base of a drilling device at extracting opening for extraction of coalbed methane.
Figure 2:
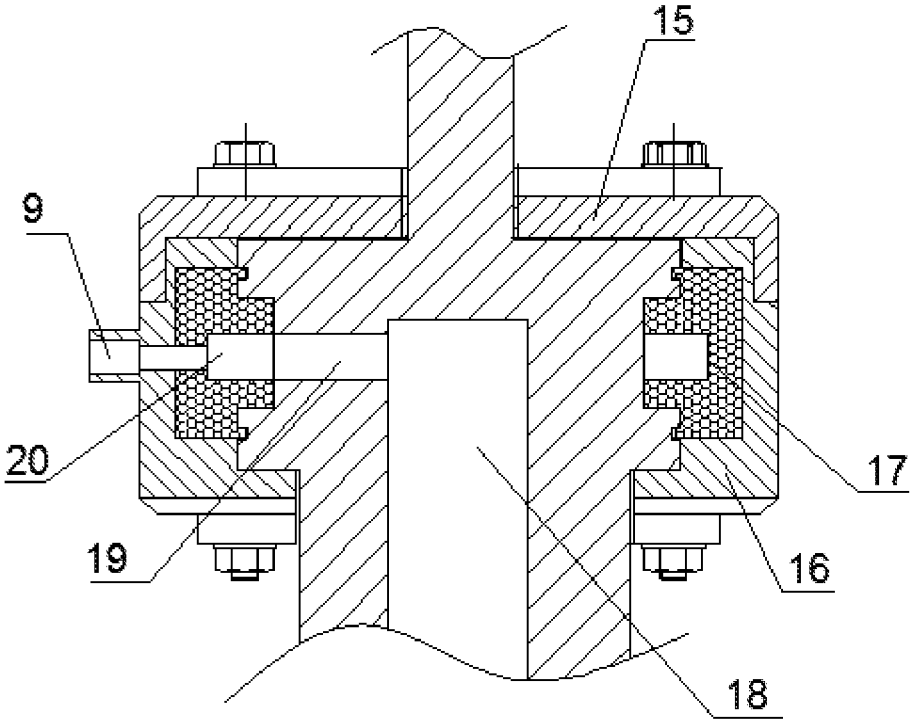
FIG. 2 is a diagram showing an internal structure of a drilling liquid injection disc assembly of a drilling device at extracting opening for extraction of coalbed methane.
Figure 3:
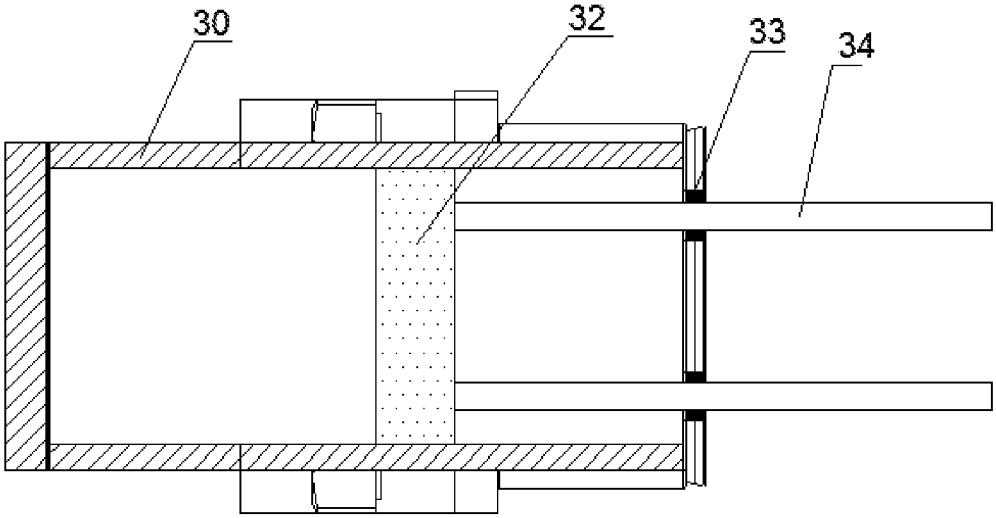
FIG. 3 is a diagram showing a structure of a detachment control driver of a drilling device at extracting opening for extraction of coalbed methane.
Figure 4:
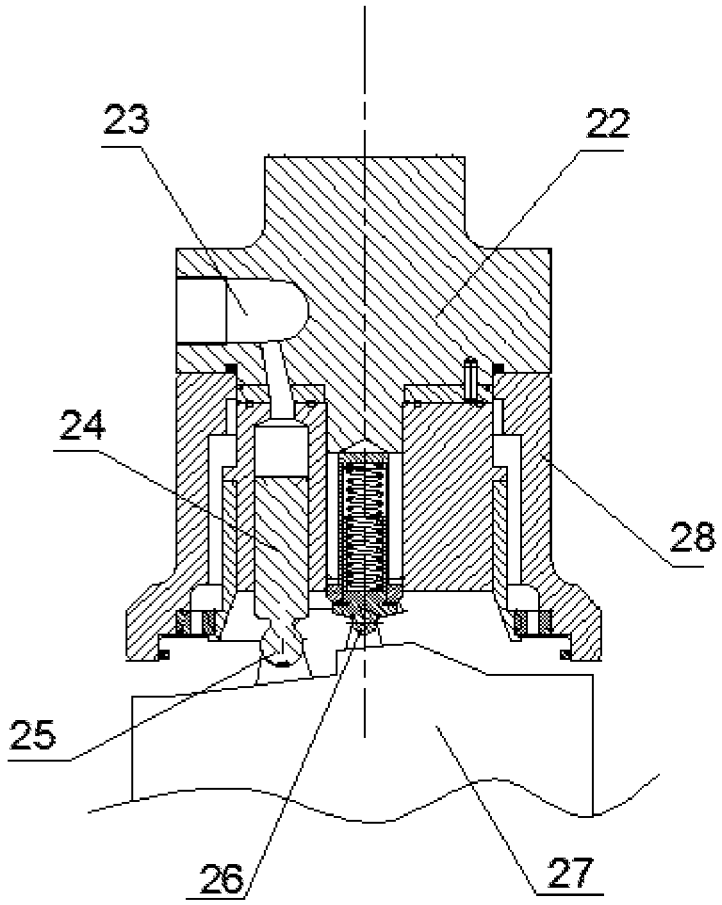
FIG. 4 is a diagram showing a structure of a fine-angle-adjustment mechanism of a drilling device at extracting opening for extraction of coalbed methane.

With reference to FIGS. 1 to 4, in an embodiment of the present disclosure, a drilling device at extracting opening for extraction of coalbed methane includes a drilling machine base 2, a main drive column 12, an auxiliary drive mechanism, a drilling liquid injection disc assembly 10, a main drill pipe 11, a fine-angle-adjustment mechanism, an secondary drill pipe 27 and a drill bit, wherein a center in the drilling machine base 2 is vertically penetrated with the main drive column, and at least one set of the auxiliary drive mechanism located in the drilling machine base is provided around the main drive column; a position of a lower end of the main drive column 12 extending the drilling machine base is fixed connected to the drilling liquid injection disc assembly 10, and a lower end of the drilling liquid injection disc assembly 10 is connected to the main drill pipe 11; a lower end of the main drill pipe 11 is connected to the secondary drill pipe 27 through the fine-angle-adjustment mechanism, and a lower end of the secondary drill pipe is connected to the drill bit; further it includes a controller and a rotary torque sensor 6, the rotary torque sensor 6 capable of detecting a rotary torque of the main drive column and feeding to the controller, the controller capable of controlling the auxiliary drive mechanism according to the rotary torque; and when the rotary torque is greater than a set value, the controller controls the auxiliary drive mechanism to transmit to the main drive column and drives the main drive column, and when the rotary torque is smaller than or equal to the set value, the controller controls a force transmission between the auxiliary drive mechanism and the main drive column to be disconnected;

The fine-angle-adjustment mechanism is capable of controlling the secondary drill bit 27 and/or the drill bit to perform a fine-tuned swinging motion in space, so as to prevent the drill bit from getting stuck or chipping during the drilling process. Generally speaking, the range of the fine-tuning angle may be set to ±5° or ±10°.

As a preferred embodiment, the auxiliary drive mechanism includes an auxiliary motor 5, a belt transmission mechanism 4, a main auxiliary drive column 7, an secondary auxiliary drive column 8, an auxiliary transmission gear 14 and an auxiliary gear 13, wherein the auxiliary motor 5 is fixed in the drilling machine base, and an output terminal of the auxiliary motor is connected to the main auxiliary drive column 7 through the belt transmission mechanism 4; the main auxiliary drive column 7 is coaxially connected to the secondary auxiliary drive column 8, and the secondary auxiliary drive column 8 is connected with the auxiliary transmission gear 14; the main drive column is provided with the auxiliary gear 13, and the auxiliary transmission gear 14 and the auxiliary gear 13 are in detachable/transmittable connection.

Among them, the auxiliary drive mechanism further includes a detachment control driver 29, and the auxiliary transmission gear 14 is slidably disposed on the secondary auxiliary drive column 8 up and down by the detachment control driver 29, so as to control the detachment and transmission of the auxiliary transmission gear 14 and the auxiliary gear 13.

An anti-over-torque connecting member is adopted between the main auxiliary drive column 7 and the secondary auxiliary drive column 8, and the anti-over-torque connecting member is configured to automatically rotate relatively when a rotary torque between the main auxiliary drive column 7 and the secondary auxiliary drive column 8 is greater than a certain value, so as to prevent the rotary torque of transmission between the main auxiliary drive column 7 and the secondary auxiliary drive column 8 from being excessive. A top of the drilling machine base is provided with a machine cover 1, a pulley 3 is disposed above the machine cover 1, and the pulley 3 is connected to an upper end of the main drive column.

To facilitate injection of the drilling liquid, the drilling liquid injection disc assembly 10 includes a disc body 16, a sealing cover 15, and a sealed liquid injection sleeve 17, wherein an upper end of the disc body is fixed with the sealing cover, and a lower end of the main drive column extends into the disc body to be fixedly connected to an upper end of the main drill pipe; an outer periphery of the main drill pipe is rotatably connected to the sealed liquid injection sleeve, and the sealed liquid injection sleeve is fixed in the disc body; a radial annular liquid injection tank 20 is disposed on the sealed liquid injection sleeve, and a center of the main drill pipe is provided with a liquid drilling hole 18; the liquid drilling hole is communicated with the annular liquid injection tank 20 by a radial communication hole 19. One side of the disc body is provided with a liquid injection joint 9, the liquid injection joint 9 is communicated to the annular liquid injection tank 20 on the sealed liquid injection sleeve 17, and a sealed and rotatable arrangement is disposed between the sealed liquid injection sleeve 17 and an outer peripheral wall of the main drill pipe.

The outer peripheral wall of the main drill pipe is opened with at least two sets of concave annular sealed grooves, and positions of the sealed liquid injection sleeve 17 corresponding to the concave annular sealed grooves are provided with sealed annular shoulders extending into the concave annular sealed grooves.

The fine-angle-adjustment mechanism includes a connecting base 22, a hydraulic driver 23, a hydraulic drive column 24, and a protective disc 28, wherein an upper end of the connecting base is connected to the main drill pipe, and a lower end of the connecting base is provided with at least one hydraulic drive column driven by the hydraulic driver; a lower end of the hydraulic drive column 24 is hingedly connected to an upper end of the secondary drill pipe 27 by a ball hinge 25, and a center of the lower end of the connecting base 33 is connected to a center of the secondary drill pipe 27 by a hinged column 26; the hydraulic drive column 24 is driven up and down, and the protective disc 28 is sleeved around a lower part of the connecting base 22.

The detachment control driver 29 includes a detachment hydraulic drive base 30, a sealed ring 33, and a drive column 34, wherein a drive piston 32 is slidably disposed in the detachment hydraulic drive base 30, and two drive columns are symmetrically connected to the drive piston; the drive columns extend from the detachment hydraulic drive base and are sealed by the sealed ring 33, and upper ends of the drive column 34 are symmetrically connected to the auxiliary transmission gear 14.

In the present disclosure, by providing a rotary torque sensor and an auxiliary drive mechanism, the drilling drive can be well controlled according to the required torque. For example, when encountering rock formations, the auxiliary drive mechanism can be used for simultaneous driving drilling, and when drilling in soft formations, only by disconnecting the transmission can the operation be completed, so as to effectively reduce energy consumption and improve utilization. In the present disclosure, when a rotary torque is greater than a set value, the controller controls the auxiliary drive mechanism to transmit to the main drive column and drive the main drive column, and when the rotary torque is smaller than or equal to the set value, the controller controls the power transmission between the auxiliary drive mechanism and the main drive column to be disconnected. In this way, the main drive column can be assisted to prevent problems such as breaking rods;

in the present disclosure, the fine-angle-adjustment mechanism is capable of controlling the secondary drill bit and/or the drill bit to perform a fine-tuned swinging motion in space, so as to prevent the drill bit from getting stuck or chipping during the drilling process, thereby effectively improving the drilling efficiency while preventing drill bit from being damaged.

What is mentioned above is only the specific implementation of the present invention, but does not limit the protection scope of the present invention, and any equivalent replacements or changes made by those skilled in the art in the technical scope disclosed by the present disclosure within the technical scope disclosed by the present disclosure shall be covered by the protection scope of the present disclosure.

We claim:

1. A drilling device at extracting opening for extraction of coalbed methane, comprising a drilling machine base (2), a main drive column (12), an auxiliary drive mechanism, a drilling liquid injection disc assembly (10), a main drill pipe (11), a fine-angle-adjustment mechanism, an secondary drill pipe (27) and a drill bit, wherein a center in the drilling machine base (2) is vertically penetrated with the main drive column, and at least one set of the auxiliary drive mechanism located in the drilling machine base is provided around the main drive column; a position of a lower end of the main drive column (12) extending the drilling machine base is fixed connected to the drilling liquid injection disc assembly (10), and a lower end of the drilling liquid injection disc assembly (10) is connected to the main drill pipe (11); a lower end of the main drill pipe (11) is connected to the secondary drill pipe (27) through the fine-angle-adjustment mechanism, and a lower end of the secondary drill pipe is connected to the drill bit;

further comprising a controller and a rotary torque sensor (6), the rotary torque sensor (6) capable of detecting a rotary torque of the main drive column and feeding to the controller, the controller capable of controlling the auxiliary drive mechanism according to the rotary torque; and when the rotary torque is greater than a set value, the controller controls the auxiliary drive mechanism to transmit to the main drive column and drives the main drive column, and when the rotary torque is smaller than or equal to the set value, the controller controls a force transmission between the auxiliary drive mechanism and the main drive column to be disconnected;

the fine-angle-adjustment mechanism is capable of controlling the secondary drill bit (27) and/or the drill bit to perform a fine-tuned swinging motion in space, so as to prevent the drill bit from getting stuck or chipping during the drilling process;

wherein the auxiliary drive mechanism comprises an auxiliary motor (5), a belt transmission mechanism (4), a main auxiliary drive column (7), an secondary auxiliary drive column (8), an auxiliary transmission gear (14) and an auxiliary gear (13), wherein the auxiliary motor (5) is fixed in the drilling machine base, and an output terminal of the auxiliary motor is connected to the main auxiliary drive column (7) through the belt transmission mechanism (4); the main auxiliary drive column (7) is coaxially connected to the secondary auxiliary drive column (8), and the secondary auxiliary drive column (8) is connected with the auxiliary transmission gear (14); the main drive column is provided with the auxiliary gear (13), and the auxiliary transmission gear (14) and the auxiliary gear (13) are in detachable/transmittable connection.

2. The drilling device at extracting opening for extraction of coalbed methane according to claim 1, wherein the auxiliary drive mechanism further comprises a detachment control driver (29), and the auxiliary transmission gear (14) is slidably disposed on the secondary auxiliary drive column (8) up and down by the detachment control driver (29), so as to control the detachment and transmission of the auxiliary transmission gear (14) and the auxiliary gear (13).

3. The drilling device at extracting opening for extraction of coalbed methane according to claim 2, wherein the detachment control driver (29) comprises a detachment hydraulic drive base (30), a sealed ring (33), and a drive column (34), wherein a drive piston (32) is slidably disposed in the detachment hydraulic drive base (30), and two drive columns are symmetrically connected to the drive piston; the drive columns extend from the detachment hydraulic drive base and are sealed by the sealed ring (33), and upper ends of the drive column (34) are symmetrically connected to the auxiliary transmission gear (14).

4. The drilling device at extracting opening for extraction of coalbed methane according to claim 1, wherein an anti-over-torque connecting member is adopted between the main auxiliary drive column (7) and the secondary auxiliary drive column (8), and the anti-over-torque connecting member is configured to automatically rotate relatively when a rotary torque between the main auxiliary drive column (7) and the secondary auxiliary drive column (8) is greater than a certain value, so as to prevent the rotary torque of transmission between the main auxiliary drive column (7) and the secondary auxiliary drive column (8) from being excessive.

5. The drilling device at extracting opening for extraction of coalbed methane according to claim 1, wherein a top of the drilling machine base is provided with a machine cover (1), a pulley (3) is disposed above the machine cover (1), and the pulley (3) is connected to an upper end of the main drive column.

6. The drilling device at extracting opening for extraction of coalbed methane according to claim 1, wherein the drilling liquid injection disc assembly (10) comprises a disc body (16), a sealing cover (15), a sealed liquid injection sleeve (17), wherein an upper end of the disc body is fixed with the sealing cover, and a lower end of the main drive column extends into the disc body to be fixedly connected to a lower end of the main drill pipe; an outer periphery of the main drill pipe is rotatably connected to the sealed liquid injection sleeve, and the sealed liquid injection sleeve is fixed in the disc body; a radial annular liquid injection tank (20) is disposed on the sealed liquid injection sleeve, and a center of the main drill pipe is provided with a liquid drilling hole (18); the liquid drilling hole is communicated with the annular liquid injection tank (20) by a radial communication hole (19).

7. The drilling device at extracting opening for extraction of coalbed methane according to claim 6, wherein one side of the disc body is provided with a liquid injection joint (9), the liquid injection joint (9) is communicated to the annular liquid injection tank (20) on the sealed liquid injection sleeve (17), and a sealed and rotatable arrangement is disposed between the sealed liquid injection sleeve (17) and an outer peripheral wall of the main drill pipe.

8. The drilling device at extracting opening for extraction of coalbed methane according to claim 7, wherein the outer peripheral wall of the main drill pipe is opened with at least two sets of concave annular sealed grooves, and positions of the sealed liquid injection sleeve (17) corresponding to the concave annular sealed grooves are provided with sealed annular shoulders extending into the concave annular sealed grooves.

9. The drilling device at extracting opening for extraction of coalbed methane according to claim 1, wherein the fine-angle-adjustment mechanism comprises a connecting base (22), a hydraulic driver (23), a hydraulic drive column (24), and a protective disc (28), wherein an upper end of the connecting base is connected to the main drill pipe, and a lower end of the connecting base is provided with at least one hydraulic drive column driven by the hydraulic driver; a lower end of the hydraulic drive column (24) is hingedly connected to an upper end of the secondary drill pipe (27) by a ball hinge (25), and a center of the lower end of the connecting base (22) is connected to a center of the secondary drill pipe (27) by a hinged column (26); the hydraulic drive column (24) is driven up and down, and the protective disc (28) is sleeved around a lower part of the connecting base (22).

* * * * *